US009050698B2

(12) United States Patent
Yasuda et al.

(10) Patent No.: US 9,050,698 B2
(45) Date of Patent: Jun. 9, 2015

(54) MANUFACTURING METHOD OF CARRIER FOR DOUBLE-SIDE POLISHING APPARATUS, CARRIER FOR DOUBLE-SIDE POLISHING APPARATUS, AND DOUBLE-SIDE POLISHING METHOD OF WAFER

(75) Inventors: Taichi Yasuda, Tokyo (JP); Tatsuo Enomoto, Tokyo (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 548 days.

(21) Appl. No.: 13/379,482

(22) PCT Filed: Jun. 18, 2010

(86) PCT No.: PCT/JP2010/004077

§ 371 (c)(1),
(2), (4) Date: Dec. 20, 2011

(87) PCT Pub. No.: WO2011/010423

PCT Pub. Date: Jan. 27, 2011

(65) Prior Publication Data

US 2012/0100788 A1 Apr. 26, 2012

(30) Foreign Application Priority Data

Jul. 21, 2009 (JP) ..... 2009-170138

(51) Int. Cl.
*B24B 37/28* (2012.01)

(52) U.S. Cl.
CPC ..... *B24B 37/28* (2013.01); *Y10T 29/49826* (2015.01)

(58) Field of Classification Search
CPC ..... B24B 37/28; Y10T 29/49826
USPC ..... 451/41, 63, 285–290, 397, 398
See application file for complete search history.

(56) References Cited

U.S. PATENT DOCUMENTS 5,244,555 A * 9/1993 Allen et al. ..... 204/192.2
6,439,984 B1 * 8/2002 Andres ..... 451/398

(Continued)

FOREIGN PATENT DOCUMENTS

JP A-2000-210863 8/2000
JP A-2001-198804 7/2001

(Continued)

OTHER PUBLICATIONS

International Search Report issued in Application No. PCT/JP2010/004077; Dated Jul. 13, 2010.

(Continued)

*Primary Examiner* — Maurina Rachuba
(74) *Attorney, Agent, or Firm* — Oliff PLC

(57) ABSTRACT

A manufacturing method of a carrier for a double-side polishing apparatus for polishing surfaces of a wafer, the carrier having: a carrier body arranged between upper and lower turn tables, the carrier body having a holding hole for holding the wafer; and a ring-shaped resin insert arranged along an inner circumference of the holding hole, the resin insert having an inner circumferential surface to be brought into contact with a peripheral portion of the wafer to be held, the method having the steps of attaching, to the holding hole of the carrier body, a base material for the resin insert not having the inner circumferential surface to be brought into contact with the wafer to be held, and performing inner-circumferential-surface-forming processing on the base material for the resin insert to form the inner circumferential surface to be brought into contact with the peripheral portion of the wafer to be held.

8 Claims, 8 Drawing Sheets

(56) References Cited

U.S. PATENT DOCUMENTS

| | | | | |
|---|---|---|---|---|
| 2007/0184662 | A1 | 8/2007 | Yamashita et al. | |
| 2011/0104995 | A1 * | 5/2011 | Ueno et al. | 451/41 |

FOREIGN PATENT DOCUMENTS

| | | | |
|---|---|---|---|
| JP | A-2003-305637 | | 10/2003 |
| JP | A-2003-340711 | | 12/2003 |
| WO | WO 2006/001340 | A1 | 1/2006 |

OTHER PUBLICATIONS

Taiwanese Patent Office, Office Action issued on Feb. 21, 2014 in Taiwanese Patent Application No. 099120481 w/Partial English-language Translation.

Feb. 7, 2012 International Preliminary Report on Patentability issued in International Patent Application No. PCT/JP2010/004077.

Dec. 11, 2012 Office Action issued in Japanese Application No. 2009-170138 (with translation).

* cited by examiner (A)

(B)

| | | EXAMPLE 1 (θ=90°) | EXAMPLE 2 (θ=88°) | EXAMPLE 2 (θ=92°) | COMPARATIVE EXAMPLE (θ=72.5°) | COMPARATIVE EXAMPLE (θ=107.5°) |
|---|---|---|---|---|---|---|
| | WAFER SHAPE |  |  |  |  |  |
| | NANO-TOPOLOGY MAP |  |  |  |  |  |
| FLAT NESS | GBIR | 0.134 | 0.147 | 0.139 | 0.165 | 0.168 |
| | SFQRmax | 0.028 | 0.030 | 0.033 | 0.111 | 0.115 |
| | Roll Off | 0.009 | 0.012 | 0.015 | 0.060 | 0.088 |
| NANO-TOPO LOGY | 2.0mm□ | 8.23 | 8.84 | 8.75 | 10.14 | 11.32 |
| | 5.0mm□ | 10.79 | 10.93 | 10.85 | 14.34 | 17.53 |
| | 10.0mm□ | 19.88 | 20.01 | 19.99 | 26.11 | 30.56 |

A: WAFER FRONT SURFACE SHAPE B: WAFER THICKNESS C: WAFER BACK SURFACE SHAPE (A)

(B)

MANUFACTURING METHOD OF CARRIER FOR DOUBLE-SIDE POLISHING APPARATUS, CARRIER FOR DOUBLE-SIDE POLISHING APPARATUS, AND DOUBLE-SIDE POLISHING METHOD OF WAFER

TECHNICAL FIELD

The present invention relates to a carrier for a double-side polishing apparatus used for polishing both surfaces of a wafer simultaneously, a manufacturing method of the same, and a double-side polishing method of a wafer with the double-side polishing apparatus.

BACKGROUND ART

When both surfaces of a wafer are polished simultaneously by polishing processing and the like, the wafer is held by a carrier for a double-side polishing apparatus.

FIG. 8 is a schematic explanatory view explaining polishing of the wafer by a general double-side polishing apparatus that has been conventionally used. As shown in FIG. 8, the carrier 101 for a double-side polishing apparatus is formed to have a thickness thinner than that of the wafer W, and has a holding hole 104 for holding the wafer W at a predetermined position between an upper turn table 108 and a lower turn table 109 of the double-side polishing apparatus 120.

The wafer W is inserted into the holding hole 104 to hold it, and upper and lower surfaces of the wafer W are sandwiched by polishing pads 110 attached on surfaces of the upper turn table 108 and the lower turn table 109, facing to the wafer.

The carrier 101 for a double-side polishing apparatus is engaged with a sun gear 111 and an internal gear 112, and is rotated and revolved by driving to rotate the sun gear 111. Both surfaces of the wafer W are polished simultaneously with the polishing pads 110 attached to the upper and lower turn tables by rotating the upper turn table 108 and the lower turn table 109 in an opposite direction to each other, while supplying a polishing agent to the surfaces to be polished.

The above-described carrier 101 for a double-side polishing apparatus used in a double-side polishing process of the wafer W is mostly made of metal. A resin insert 103 is therefore attached along an inner circumference of the holding hole 104 formed in a carrier body 102 in order to protect a peripheral portion of the wafer W from damage caused by the metal carrier 101. With regard to attachment of the resin insert, it has been conventionally known that an outer circumferential portion of the resin insert is formed into a wedge shape, fitted into the carrier body, and further fixed by an adhesive in order to prevent the resin insert from coming off during processing and conveying the wafer (See Patent Literature 1).

When the wafer W is polished with the above-described double-side polishing apparatus 120, however, a sag may be generated at an outer circumference of the wafer W, and nano-topology failure may be generated in some cases.

CITATION LIST

Patent Literature

Patent Literature 1: Pamphlet of International Publication No. WO2006/001340

SUMMARY OF INVENTION

The present inventor investigated the cause of the generation of the outer peripheral sag and nano-topology failure of the wafer. As a result, the present inventor found the following. As shown in FIGS. 9(A) and (B), when an inner circumferential surface 106 of the resin insert 103 coming into contact with the peripheral portion of the wafer W to be polished is inclined with respect to a main surface 105 of the carrier, pressing force of the carrier 101 against the wafer W generates not only parallel component to the main surface 105 of the polishing pads and carrier but also component pressing the wafer upwardly or downwardly. Consequently, the wafer W is locally pressed to the polishing pads, and thereby the outer peripheral sag and nano-topology failure are generated.

Conventionally, in manufacture of the carrier for a double-side polishing apparatus by combination between the carrier body and resin insert, first, the carrier body and the resin insert are separately fabricated, and thereafter the resin insert is attached to the carrier body.

When the resin insert is fabricated, a resin base material is cut to form a ring having a wedge-shaped outer circumferential portion. Since the width of the ring containing the wedge-shaped portion is typically as small as 5 mm or less, this part has low mechanical strength, and is easily strained. Moreover, a cutting length of the wedge-shaped portion is longer than a length of the inner circumferential surface of the resin insert. This longer cutting length causes expansion of the resin base material due to generated processing heat, and it is easily strained before inserting into the carrier body.

In addition, to prevent the resin insert from coming off during processing, there is no room to increase dimensional tolerance of wedge-shaped fitting portions of the carrier body and the resin insert. Because of differences of processing precision and mechanical strength between them, the resin insert is inserted into the carrier body in a condition where the resin insert is strained.

When the above-described strained resin insert is inserted into the carrier body having low tolerance, the resin insert is consequently strained more. For example, even when an angle between the inner circumferential surface of the resin insert and the main surface of the carrier needs to be a right angle, the angle does not become a right angle but inclined due to the strain.

The present invention was accomplished in view of the above-explained problems, and its object is to provide a manufacturing method of a carrier for a double-side polishing apparatus that enables suppression of the strain of the resin insert to form the inner circumferential surface into a desirable shape with high precision and thereby enables suppression of the outer peripheral sag and nano-topology failure of the polished wafer.

An another object of the present invention is to provide a double-side polishing method of a wafer that enables suppression of the outer peripheral sag and nano-topology failure of the polished wafer due to the strain of the resin insert.

To achieve this object, the present invention provides a manufacturing method of a carrier for a double-side polishing apparatus for polishing both surfaces of a wafer, the carrier having: a carrier body arranged between upper and lower turn tables each having a polishing pad attached thereto, the carrier body having a holding hole for holding the wafer to be sandwiched between the upper and lower turn tables during polishing; and a ring-shaped resin insert arranged along an inner circumference of the holding hole of the carrier body, the resin insert having an inner circumferential surface to be brought into contact with a peripheral portion of the wafer to be held, the method comprising at least the steps of attaching, to the holding hole of the carrier body, a base material for the resin insert not having the inner circumferential surface to be brought into contact with the wafer to be held, and thereafter performing inner-circumferential-surface-forming processing on the base material for the resin insert to form the inner circumferential surface to be brought into contact with the peripheral portion of the wafer to be held.

In this manner, when the method has at least the steps of attaching, to the holding hole of the carrier body, the base material for the resin insert not having the inner circumferential surface to be brought into contact with the wafer to be held, and thereafter performing inner-circumferential-surface-forming processing on the base material for the resin insert to form the inner circumferential surface to be brought into contact with the peripheral portion of the wafer to be held, the carrier for a double-side polishing apparatus can be manufactured which enables the suppression of the strain of the resin insert to form the inner circumferential surface into a desirable shape with high precision and thereby enables the suppression of the outer peripheral sag and nano-topology failure of the polished wafer.

In this case, the inner-circumferential-surface-forming processing can be performed so that an angle θ between the inner circumferential surface of the resin insert and a main surface of the carrier body satisfies a condition of $88° \leq \theta \leq 92°$.

In this manner, when the inner-circumferential-surface-forming processing is performed so that the angle θ between the inner circumferential surface of the resin insert and the main surface of the carrier body satisfies a condition of $88° \leq \theta \leq 92°$, the carrier for a double-side polishing apparatus can be manufactured which enables the outer peripheral sag and nano-topology failure of the polished wafer to be more surely suppressed.

In this case, the base material for the resin insert to be used can be of a disklike shape or a ring shape having an inner diameter smaller than a diameter of the wafer.

In this manner, when the base material for the resin insert to be used is of a disklike shape, the strain of the resin insert can be more surely suppressed. When the base material for the resin insert to be used is of a ring shape having an inner diameter smaller than a diameter of the wafer, the strain of the resin insert can be sufficiently suppressed.

In this case, the base material for the resin insert can be made of aramid resin.

In this manner, when the base material for the resin insert is made of aramid resin, the mechanical strength thereof becomes high while it is capable of protecting the peripheral portion of the wafer W from damage caused by the carrier.

Furthermore, the present invention provides a carrier for a double-side polishing apparatus manufactured by the above-described manufacturing method of a carrier for a double-side polishing apparatus according to the present invention.

The carrier for a double-side polishing apparatus manufactured by the above-described manufacturing method of a carrier for a double-side polishing apparatus according to the present invention has the resin insert in which the strain is suppressed and the inner circumferential surface is formed into a desirable shape with high precision, and thereby enables the suppression of the outer peripheral sag and nano-topology failure during the polishing of the wafer.

Furthermore, the present invention provides a double-side polishing method of a wafer including: holding the wafer by a carrier for a double-side polishing apparatus having a holding hole for holding the wafer and a ring-shaped resin insert arranged along an inner circumference of the holding hole, the resin insert having an inner circumferential surface to be brought into contact with a peripheral portion of the wafer to be held; sandwiching the held wafer between upper and lower turn tables each having a polishing pad attached thereto; and polishing both surfaces of the wafer simultaneously, wherein an angle θ between the inner circumferential surface of the resin insert and a main surface of the carrier is preliminarily inspected before polishing the wafer, and the wafer is polished by using only the carrier in which the inspected angle θ satisfies a condition of $88° \leq \theta \leq 92°$.

In this manner, when the angle θ between the inner circumferential surface of the resin insert and the main surface of the carrier is preliminarily inspected before polishing the wafer, and the wafer is polished by using only the carrier in which the inspected angle θ satisfies a condition of $88° \leq \theta \leq 92°$, the outer peripheral sag and nano-topology failure can be surely suppressed during the polishing of the wafer.

In the manufacturing method of a carrier for a double-side polishing apparatus according to the present invention, at least the base material for the resin insert not having the inner circumferential surface to be brought into contact with the wafer to be held is attached to the holding hole of the carrier body, and thereafter the inner-circumferential-surface-forming processing is performed on the base material for the resin insert to form the inner circumferential surface to be brought into contact with the peripheral portion of the wafer to be held. Therefore, the carrier for a double-side polishing apparatus that enables the suppression of the strain of the resin insert to form the inner circumferential surface into a desirable shape with high precision and enables the suppression of the outer peripheral sag and nano-topology failure of the polished wafer can be manufactured.

Moreover, in the double-side polishing method of a wafer, the angle θ between the inner circumferential surface of the resin insert and the main surface of the carrier is preliminarily inspected before polishing the wafer, and the wafer is polished by using only the carrier in which the inspected angle θ satisfies a condition of $88° \leq \theta \leq 92°$. Therefore, the outer peripheral sag and nano-topology failure can be surely suppressed during the polishing of the wafer.

DESCRIPTION OF EMBODIMENTS

Hereinafter, an embodiment of the present invention will be explained, but the present invention is not restricted thereto.

Conventionally, in manufacture of the carrier for a double-side polishing apparatus by combination between the carrier body and resin insert, first, the carrier body and the resin insert are separately fabricated, that is, the inner-circumferential-surface-forming processing is performed on the resin insert to form it into a ring shape and thereafter the resin insert is attached to the carrier body. However, the above-described manufacture of the carrier for a double-side polishing apparatus causes the strain of the resin insert. For example, even when the processing is performed in advance in an attempt to make the angle between the inner circumferential surface of the resin insert and the main surface of the carrier a right angle, the inner circumferential surface does not become a right angle but inclined due to the strain of the resin insert after the attachment.

When the wafer is polished in this state, there arises a problem that the outer peripheral sag and the nano-topology failure are generated in the polished wafer.

In view of this, the present inventors repeatedly keenly conducted studies to solve the problem. As a result, the present inventors conceived the following. In the manufacture of the carrier for a double-side polishing apparatus, the inner-circumferential-surface-forming processing is performed on the resin insert to form the inner circumferential surface to be brought into contact with the peripheral portion of the wafer to be held, after attaching the base material for the resin insert to the carrier body, instead of forming the inner circumferential surface of the resin insert in advance. The strain of the resin insert can be thereby suppressed, and the inner circumferential surface of the resin insert can be formed into a desirable shape, such as a right angle with respect to the main surface of the carrier, with high precision.

The present inventors also conceived that the outer peripheral sag and nano-topology failure of the wafer can be surely suppressed by inspecting the angle θ between the inner circumferential surface of the resin insert and the main surface of the carrier before polishing the wafer and polishing the wafer by using only the carrier in which the inspected angle θ satisfies, particularly, a condition of $88° \leq \theta \leq 92°$, and thereby brought the present invention to completion.

Figure 1:
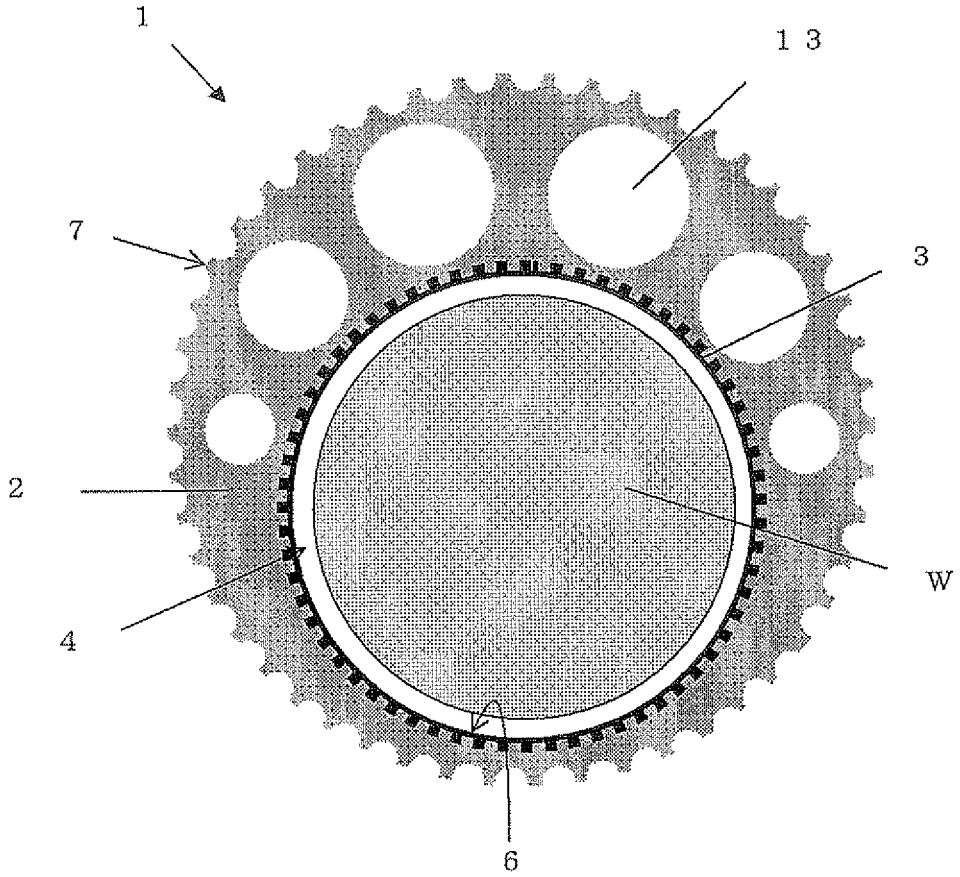
FIG. 1 is a schematic view showing an example of the carrier for a double-side polishing apparatus according to the present invention manufactured by the manufacturing method of a carrier for a double-side polishing apparatus according to the present invention.
Figure 2:
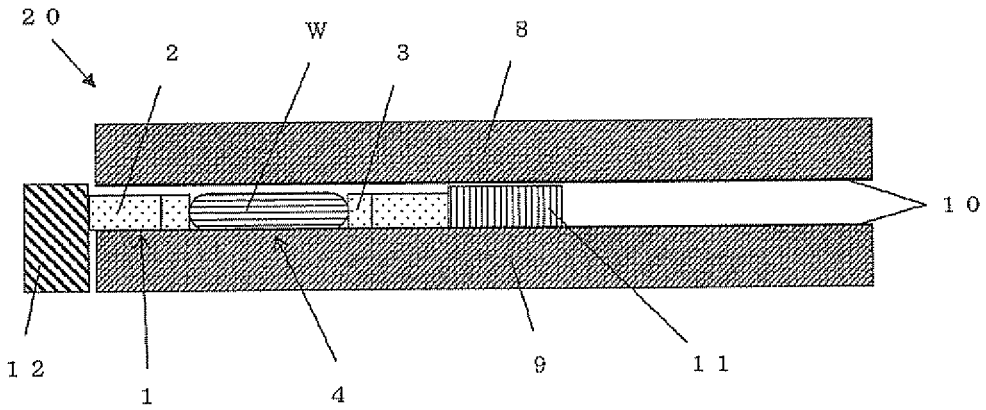
FIG. 2 is a schematic view showing an example of a double-side polishing apparatus having the carrier for a double-side polishing apparatus according to the present invention.

FIG. 1 is a schematic view showing an example of the carrier for a double-side polishing apparatus according to the present invention manufactured by the manufacturing method of a carrier for a double-side polishing apparatus according to the present invention. FIG. 2 is a schematic view showing an example of a double-side polishing apparatus having this carrier for a double-side polishing apparatus.

As shown in FIG. 1, the carrier 1 for a double-side polishing apparatus has the carrier body 2 having the holding hole 4 for holding the wafer W. The resin insert 3 is arranged along the inner circumference of the holding hole 4 of the carrier body 2. The resin insert 3 can prevent the peripheral portion of the wafer W from being damaged due to contact of the wafer W with the carrier body 2 during polishing.

The wafer W is inserted into the holding hole 4 of the carrier 1 for a double-side polishing apparatus, and held in a condition where the inner circumferential surface 6 of the resin insert 3 comes into contact with the peripheral portion of the wafer W.

Moreover, the carrier 1 for a double-side polishing apparatus is provided with a polishing-solution hole 13 through which a polishing solution passes, separately from the holding hole 4, and an outer circumferential gear 7 at the outer circumferential portion thereof.

As shown in FIG. 2, the double-side polishing apparatus 20 is provided with the upper turn table 8 and lower turn table 9 that are arranged up and down so as to face each other. The polishing pad 10 is attached to each of the facing surfaces of the upper turn table 8 and lower turn table 9. The wafer W is held in the holding hole 4 of the carrier 1 for a double-side polishing apparatus, and sandwiched between the upper turn table 8 and lower turn table 9. A sun gear 11 is placed at the center portion between the upper turn table 8 and lower turn table 9. An internal gear 12 is placed at the peripheral portion thereof.

Moreover, the teeth of the sun gear 11 and internal gear 12 are engaged with the outer circumferential gear 7 of the carrier 1 for a double-side polishing apparatus, and the carrier 1 for a double-side polishing apparatus is rotated and revolved around the sun gear 11 by rotating the upper turn table 8 and lower turn table 9 with a driving device (not shown).

Hereinafter, the manufacturing method according to the present invention for manufacturing the above-described carrier for a double-side polishing apparatus will be explained in detail.

First, the carrier body of the carrier for a double-side polishing apparatus is fabricated. As shown in FIG. 1, the holding hole 4 for holding the wafer W is formed in the carrier body 2. In addition, the above-described outer circumferential gear 7 to be engaged with the sun gear and internal gear of the double-side polishing apparatus is formed at the outer circumferential portion.

The polishing-solution hole 13 through which a polishing solution passes can be formed in the carrier body 2.

Here, the arrangement or the number of the polishing-solution hole 13 is not restricted to FIG. 1, and it may be set optionally.

Figure 3:
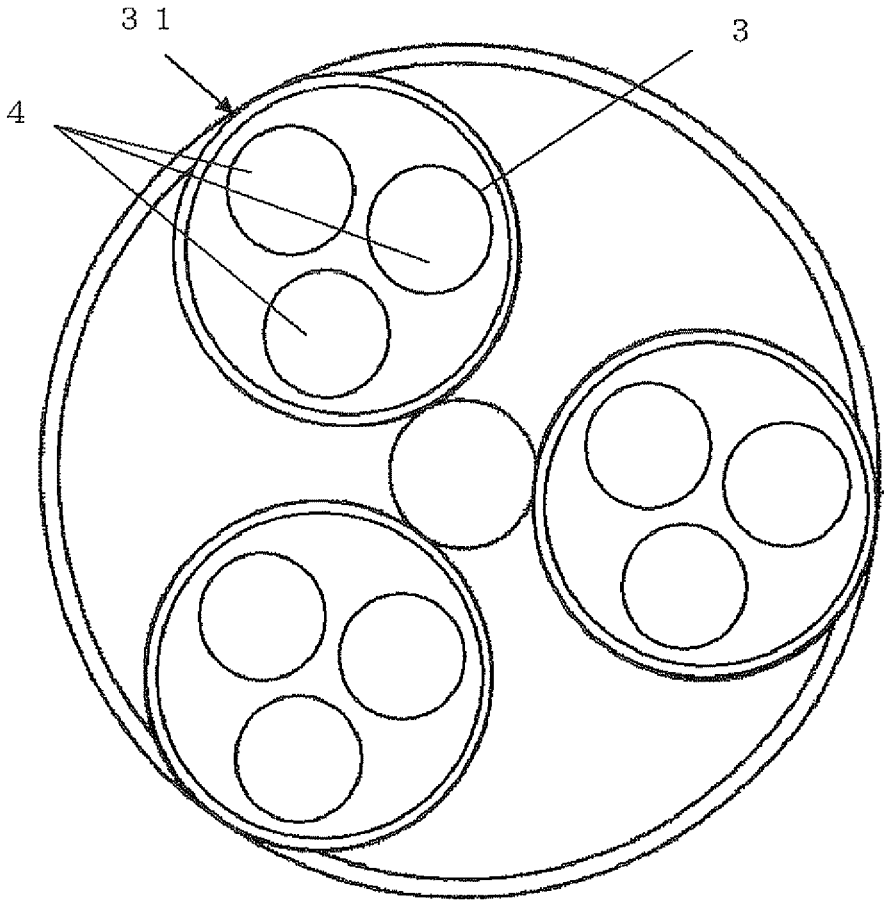
FIG. 3 is a schematic view showing another example of the carrier for a double-side polishing apparatus according to the present invention manufactured by the manufacturing method of a carrier for a double-side polishing apparatus according to the present invention.

In an example of the carrier 1 for a double-side polishing apparatus described in FIG. 1, one holding hole 4 is provided. Alternatively, as shown in FIG. 3, the carrier 31 for a double-side polishing apparatus may be configured so that a plurality of the holding holes 4 are provided and the resin insert 3 is arranged along the inner circumference of each of the holding holes 4.

Here, the material of the carrier body 2 is not restricted in particular. For example, it can be titanium. Moreover, the surface of the carrier body 2 can be coated with a DLC (Diamond Like Carbon) film with high hardness. In this manner, when it is coated with the DLC film, the durability of the carrier 1 for a double-side polishing apparatus is improved, the lifetime of the carrier can be thereby extended, and a frequency of changing it can be consequently reduced.

Moreover, there is prepared the base material for the resin insert 3 not having the inner circumferential surface 6 to be brought into contact with the wafer W to be held. The outer circumferential portion of the base material is subjected to processing for forming the shape fitting to the inner circumference of the holding hole 4 of the fabricated carrier body 2. The base material is thereafter attached to the holding holes 4 of the fabricated carrier body 2. In this case, the resin insert 3 becomes hard to come off the carrier body 2 by forming the outer circumferential portion of the base material and the inner circumferential portion of the holding hole 4 of the carrier body 2 into a wedge shape to fit. Furthermore, they can be fixed by an adhesive.

Here, the base material for the resin insert 3 can be made of aramid resin. The aramid resin is a material with high strength and high modulus of elasticity, and thereby enables the peripheral portion of the wafer W to be protected from damage caused by the carrier 1 for a double-side polishing apparatus, made of metal, such as titanium, while the durability is improved.

The inner-circumferential-surface-forming processing is thereafter performed on the base material for the resin insert 3 in a condition of being attached to the holding hole 4 of the carrier body 2, to form the inner circumferential surface to be brought into contact with the peripheral portion of the wafer to be held. Here, the inner-circumferential-surface-forming processing of the base material for the resin insert 3 can be performed by mechanical grinding processing at low cost. Alternatively, it can be more rapidly performed by laser cutting processing with high precision.

As described above, the resin insert 3 is processed to form the inner circumferential surface after attaching, to the carrier body 2, the base material for the resin insert 3 not having the inner circumferential surface to be brought into contact with the wafer W to be held, instead of a conventional method in which a ring-shaped resin insert 3 having the inner circumferential surface that is formed thereto in advance and that is to be brought into contact with the wafer W is fabricated and the resin insert is thereafter arranged in the carrier body 2. The strain of the resin insert 3 can be thereby suppressed, and the inner circumferential surface can be formed into a desired shape with high precision, for example, when the outer circumferential portion of the resin insert 3 is formed into a wedge shape or when the base material for the resin insert 3 is attached to the carrier body 2. When the wafer is polished by using the carrier for a double-side polishing apparatus according to the present invention having the resin insert in which the strain is suppressed and the inner circumferential surface is formed with high precision, the outer peripheral sag and nano-topology failure of the wafer W can be suppressed.

Figure 5:
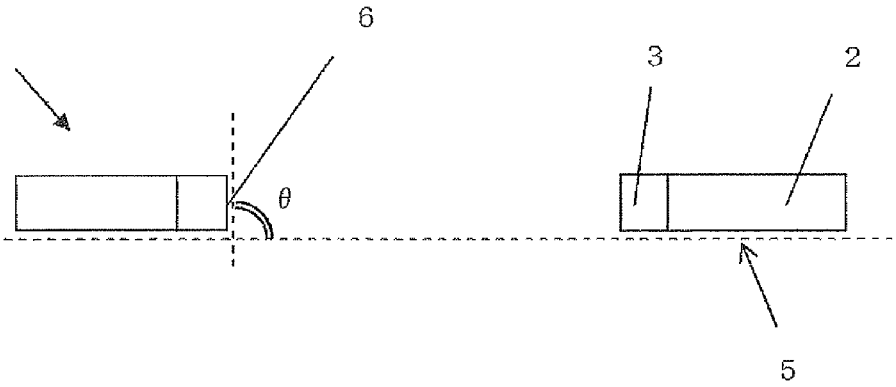
FIG. 5 is a schematic explanatory view showing an example of the shape of the inner circumferential surface by the inner-circumferential-surface-forming processing performed in the manufacturing method of a carrier for a double-side polishing apparatus according to the present invention.

In this case, particularly by performing the inner-circumferential-surface-forming processing of the resin insert 3 so that the angle θ between the inner circumferential surface 6 of the resin insert 3 and the main surface 5 of the carrier body 2 satisfies a condition of $88° \leq \theta \leq 92°$, as shown in FIG. 5, the force pressing the wafer W upwardly or downwardly by the carrier 1 for a double-side polishing apparatus can be suppressed during polishing, and the outer peripheral sag and nano-topology failure of the wafer W can be more surely suppressed.

Figure 4:
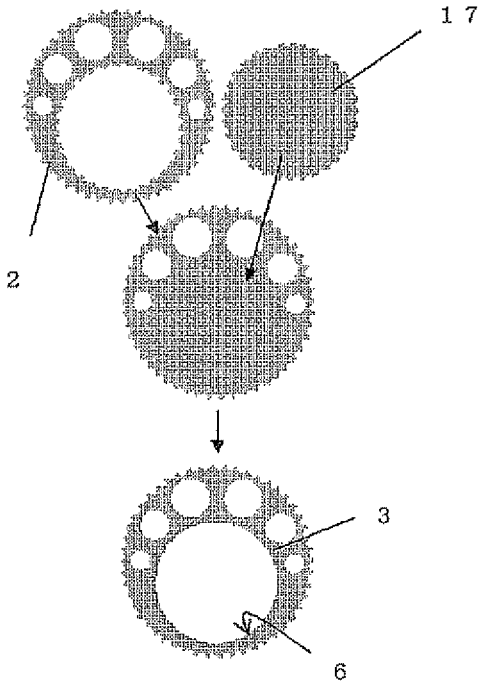
FIG. 4 are schematic explanatory views explaining an example of the manufacturing method of a carrier for a double-side polishing apparatus according to the present invention, and the base material for the resin insert used in this method, in which (A) shows a case of using a disklike-shaped base material for the resin insert, and (B) shows a case of using a ring-shaped base material for the resin insert having an inner diameter smaller than a diameter of the wafer.
Figure 4:
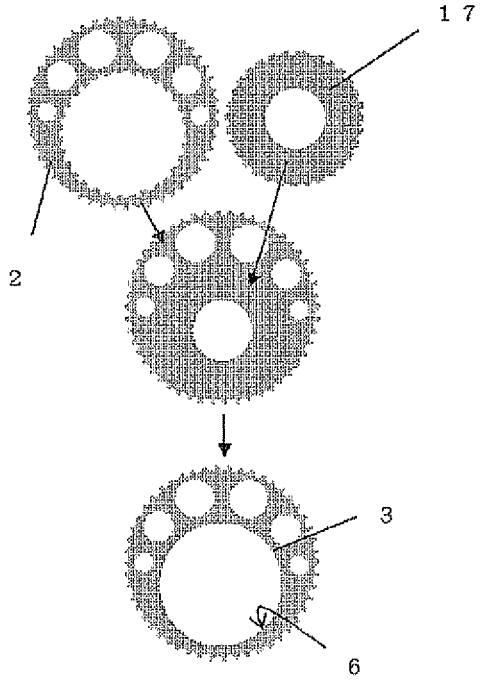

Moreover, as shown in FIG. 4(A), a disklike-shaped base material can be used as the base material for the resin insert 3. When this base material 17 is used, the strain of the base material 17 of the resin insert 3 can be surely suppressed and the inner circumferential surface 6 can be formed into a desired shape with high precision, in the formation of the outer circumferential portion of the base material 17 of the resin insert 3 into a wedge shape and in the attachment to the carrier body 2.

Moreover, as shown in FIG. 4(B), a ring-shaped base material having the inner diameter smaller than the diameter of the wafer W can be used as the base material 17 for the resin insert 3. When this base material 17 is used, the strain of the resin insert 3 can be sufficiently suppressed to form the inner circumferential surface 6 into a desired shape with high precision, and the time required for the inner-circumferential-surface-forming processing can be reduced, that is, process time of the manufacture of the carrier for a double-side polishing apparatus can be reduced.

Next, the double-side polishing method of a wafer according to the present invention will be explained. Here, a case of using the double-side polishing apparatus shown in FIG. 2 will be explained.

First, the angle θ between the inner circumferential surface 6 of the resin insert 3 and the main surface 5 of the carrier 1 for a double-side polishing apparatus is preliminarily inspected before holding the wafer W with the carrier 1 for a double-side polishing apparatus to polish it. The inspection can be performed, for example, with an outline-shape-measuring machine.

Thereafter, only the carrier 1 for a double-side polishing apparatus in which the angle θ inspected as described above satisfies a condition of $88° \leq \theta \leq 92°$ is selected. The wafer W to be polished is held in the holding hole 4 of the selected carrier 1 for a double-side polishing apparatus. The upper and lower polishing surfaces of the wafer W are sandwiched between the polishing pads 10 attached to the upper turn table 8 and lower turn table 9, and a polishing agent is supplied to the polishing surfaces to polish.

Other polishing conditions and the like may be the same as a conventional double-side polishing method.

When the wafer is polished as described above, the outer peripheral sag and nano-topology failure of the polished wafer can be surely suppressed.

It is to be noted that the carrier in which the angle θ between the inner circumferential surface 6 of the resin insert 3 and the main surface 5 of the carrier 1 for a double-side polishing apparatus satisfies a condition of $88° \leq \theta \leq 92°$ can be surely manufactured by the manufacturing method of a carrier for a double-side polishing apparatus according to the present invention.

Hereinafter, the present invention will be explained in more detail with reference to Examples and Comparative Example, but the present invention is not restricted thereto.

Example 1

A carrier for a double-side polishing apparatus shown in FIG. 1 was manufactured on the basis of the manufacturing method of a carrier for a double-side polishing apparatus according to the present invention.

First, a titanium carrier body having one holding hole as shown in FIG. 1 was fabricated, and the disklike-shaped base material for the resin insert as shown in FIG. 4(A) was attached to the holding hole of the carrier body. The inner circumferential surface of the resin insert was thereafter formed by mechanical grinding processing. At this point in time, the inner circumferential surface was formed so that the angle θ between the inner circumferential surface of the resin insert and the main surface of the carrier body became 90°.

Here, aramid resin was used as the material of the resin insert.

With the double-side polishing apparatus, shown in FIG. 2, having the carrier for a double-side polishing apparatus manufactured as described above, a silicon wafer was double-side polished according to the double-side polishing method of the present invention, and the flatness and nano-topology of the wafer were evaluated. As the flatness of the wafer, GBIR, SFQR, and Roll Off were measured.

Before polishing, the outline-shape-measuring machine (made by MITUTOYO Corp.) was used to preliminarily inspect the angle θ between the inner circumferential surface of the resin insert and the main surface of the carrier. As a result, it was confirmed that the angle θ was 90°. The silicon wafer was thereafter double-side polished with the carrier.

Figure 6:
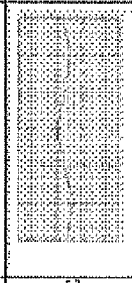
FIG. 6 is a view showing the result of Example 1, Example 2, and Comparative Example.
Figure 6:
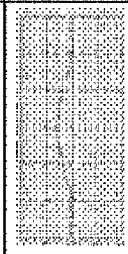
Figure 6:
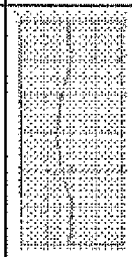
Figure 6:
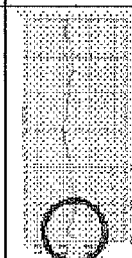
Figure 6:
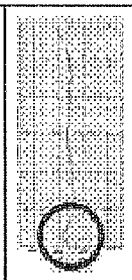
Figure 6:
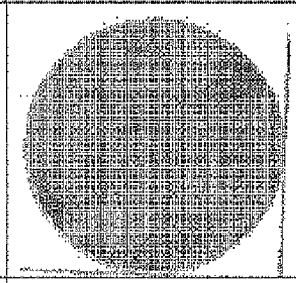
Figure 6:
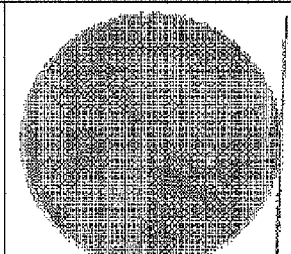
Figure 6:
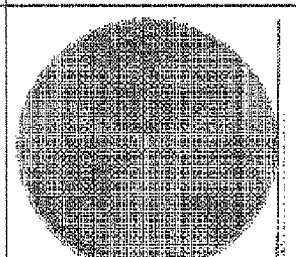
Figure 6:
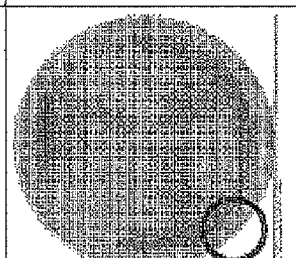
Figure 6:
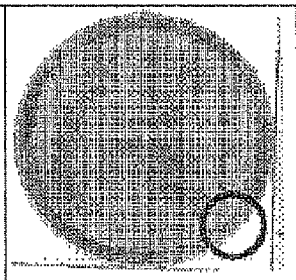

FIG. 6 shows the result of the flatness and nano-topology of the polished wafer. As shown in FIG. 6, it was revealed that the flatness and nano-topology were improved in comparison with the result of the later-explained Comparative Example.

As described above, it was confirmed that the manufacturing method of a carrier for a double-side polishing apparatus according to the present invention enables the carrier for a double-side polishing apparatus to be manufactured which can suppress the strain of the resin insert to form the inner circumferential surface into a desirable shape and thereby suppress the outer peripheral sag and nano-topology failure of the polished wafer.

In addition, it was confirmed that the double-side polishing method of a wafer according to the present invention enables the outer peripheral sag and nano-topology failure of the polished wafer to be surely suppressed.

Example 2

The carriers for a double-side polishing apparatus were manufactured as with Example 1, except that the respective angles θ between the inner circumferential surface of the resin insert and the main surface of the carrier were 88° and 92°. Silicon wafers were double-side polished and evaluated as with Example 1.

FIG. 6 shows the result of the flatness and nano-topology of the polished wafer. As shown in FIG. 6, it was revealed that the flatness and nano-topology were improved in comparison with the result of the later-explained Comparative Example and a good result was thus obtained, while the flatness and nano-topology were somewhat worse in comparison with the result of Example 1. It can be therefore said that when the angle θ satisfies a condition of $88° \leq \theta \leq 92°$, the outer peripheral sag and nano-topology failure of the polished wafer can be more surely suppressed.

Comparative Example

A carrier for a double-side polishing apparatus was manufactured by a conventional manufacturing method in which a carrier body and a resin insert were separately fabricated, and thereafter the resin insert was attached to the carrier body.

The resin insert was fabricated by processing in an attempt to make the angle between the inner circumferential surface and the main surface of the carrier body 90°. However, as a result of inspection of the angle θ between the inner circumferential surface of the resin insert and the main surface of the carrier by the outline-shape-measuring machine (made by MITUTOYO Corp.) after attaching it to the carrier, it was revealed that the angle θ was not 90° and it was thus inclined. It was considered to be caused by the strain of the resin insert.

The angle θ between the inner circumferential surface of the resin insert of the carrier for a double-side polishing apparatus manufactured as described above and the main surface of the carrier was inspected to select the carriers each having an angle θ of 72.5° and 107.5° and to double-side polish silicon wafers. The same evaluation as Example 1 was thereafter carried out.

FIG. 6 shows the result. As shown in FIG. 6, it was revealed that the flatness and nano-topology became worse than the result of Examples 1 and 2. In addition, light and shade of the nano-topology were reversed according to reversal of the inclination of the angle θ. That is, it was revealed that the surface on which the outer peripheral sag was generated was changed.

Figure 7:
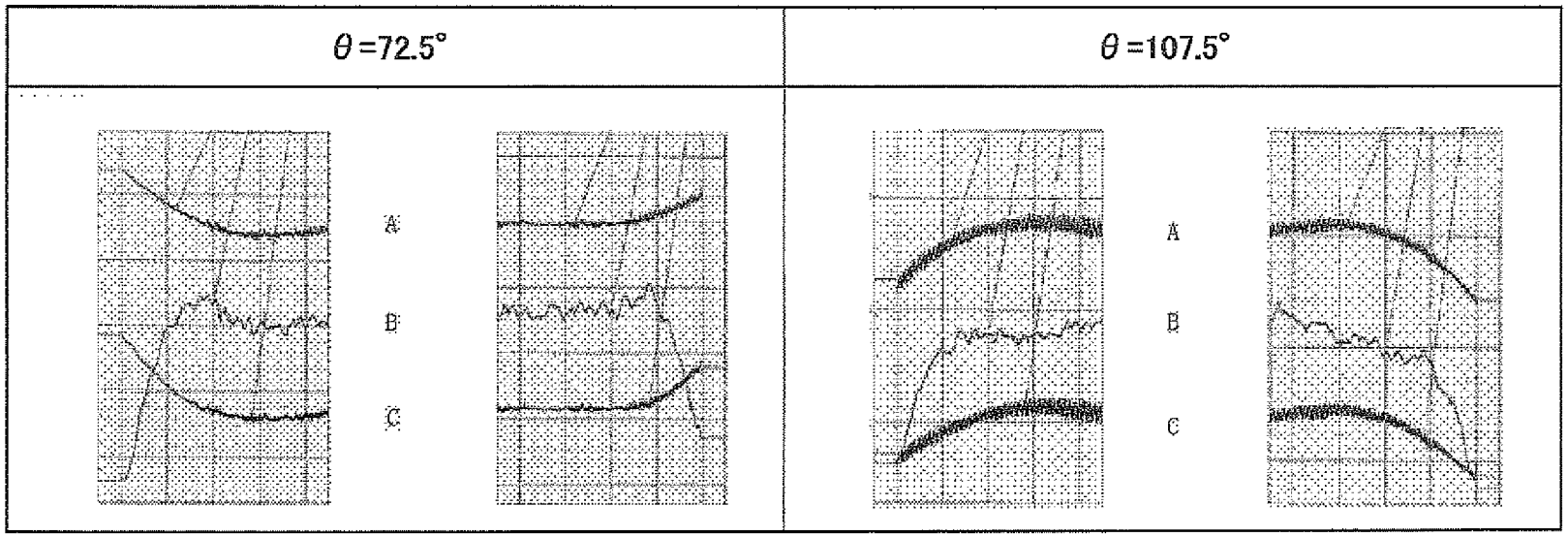
FIG. 7 is a view showing the result of the surface shape of the polished wafer in Comparative Example.
Figure 8:
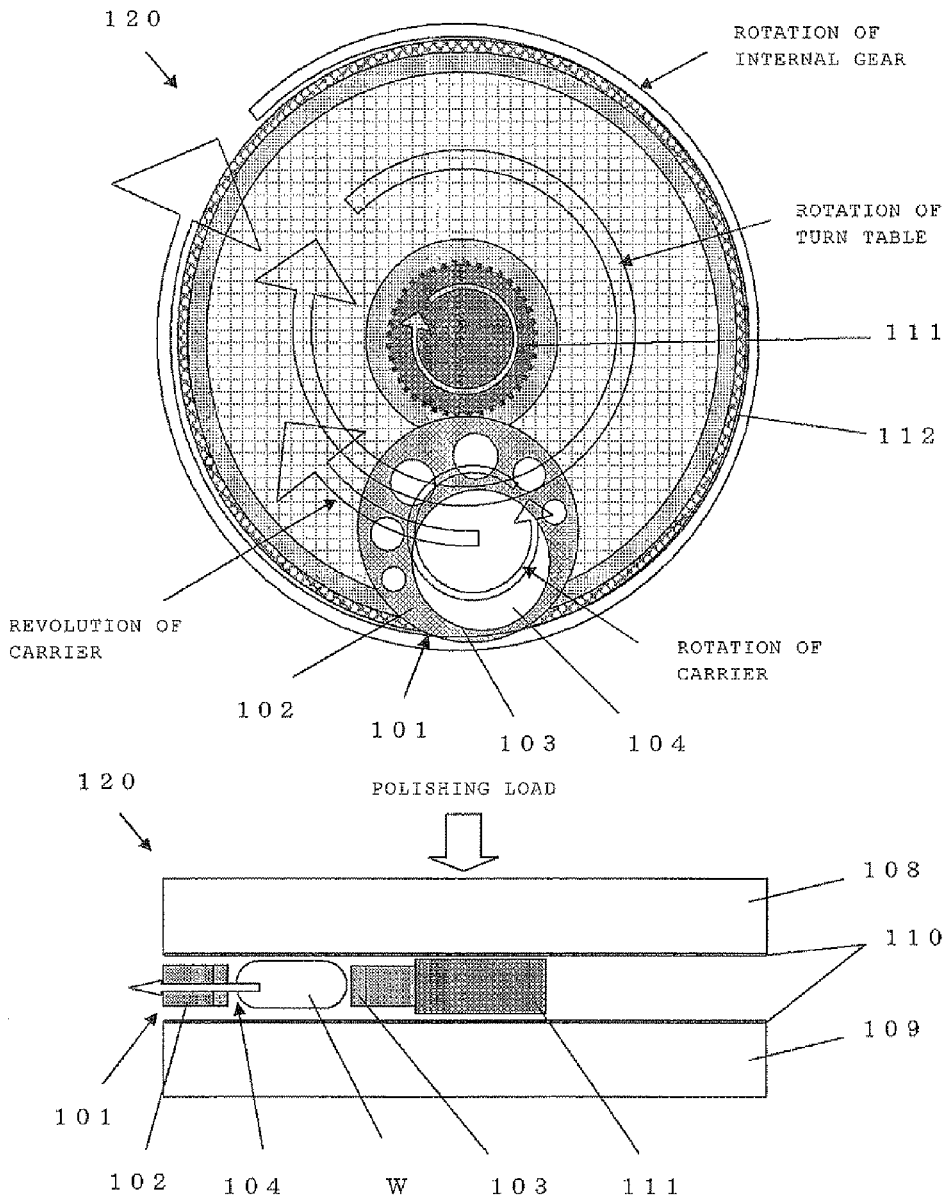
FIG. 8 is a schematic explanatory view explaining polishing of the wafer by using a general double-side polishing apparatus conventionally used.
Figure 9:
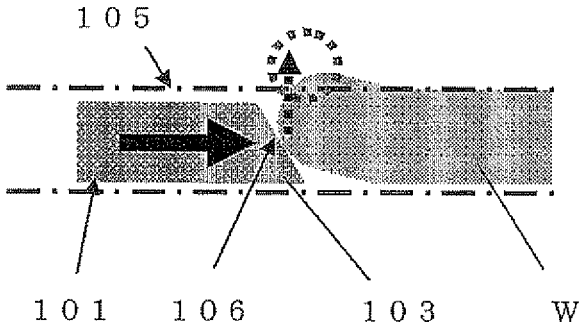
FIG. 9 is a schematic explanatory view explaining a status of a wafer polished by using a carrier for a double-side polishing apparatus, manufactured by a conventional manufacturing method, in which the resin insert is inclined due to the strain.
Figure 9:
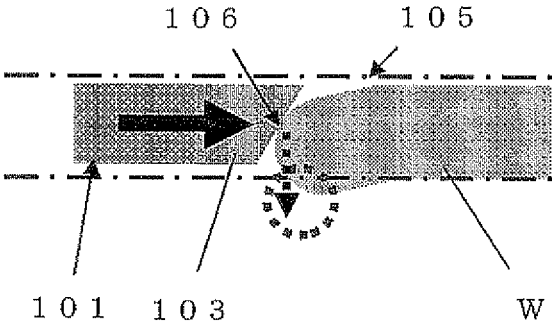

FIG. 7 shows the result of measurement of the front surface shape and back surface shape of the wafer in this case. As shown in FIG. 7, it was revealed that the shapes of the front surface and back surface of the wafer were changed according to the angle θ.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A manufacturing method of a carrier for a double-side polishing apparatus for polishing both surfaces of a wafer, the carrier comprising:

a carrier body configured to be arranged between upper and lower turn tables that each have a polishing pad attached thereto;

a holding hole disposed in the carrier body and configured to hold the wafer such that the wafer is sandwiched between the upper and lower turn tables during polishing of the wafer; and a ring-shaped resin insert arranged along an inner circumference of the holding hole, the resin insert having an inner circumferential surface configured to be brought into contact with a peripheral portion of the wafer during polishing of the wafer, the method comprising the steps of:

attaching a base material to the holding hole, the base material comprised of the resin insert before formation of the inner circumferential surface such that the base material has either (i) a ring shape with an inner diameter smaller than a diameter of the wafer or (ii) a disklike shape; and after the attaching step, performing inner-circumferential-surface-forming processing on the base material to form the inner circumferential surface on the resin insert.

2. The manufacturing method of a carrier for a double-side polishing apparatus according to claim 1, wherein the inner-circumferential-surface-forming processing is performed so that an angle θ between the inner circumferential surface of the resin insert and a main surface of the carrier body satisfies a condition of $88° \leq \theta \leq 92°$.

3. The manufacturing method of a carrier for a double-side polishing apparatus according to claim 1, wherein the base material is made of aramid resin.

4. The manufacturing method of a carrier for a double-side polishing apparatus according to claim 2, wherein the base material is made of aramid resin.

5. The manufacturing method of a carrier for a double-side polishing apparatus according to claim 1, wherein the base material has the disklike shape.

6. A manufacturing method of a carrier for a double-side polishing apparatus for polishing both surfaces of a wafer, the carrier comprising:

a carrier body configured to be arranged between upper and lower turn tables that each have a polishing pad attached thereto;

a holding hole disposed in the carrier body and configured to hold the wafer such that the wafer is sandwiched between the upper and lower turn tables during polishing of the wafer; and a ring-shaped resin insert arranged along an inner circumference of the holding hole, the resin insert having an inner circumferential surface configured to be brought into contact with a peripheral portion of the wafer during polishing of the wafer, the method comprising the steps of:

providing a base material comprised of the resin insert before formation of the inner circumferential surface such that the base material has either (i) a ring shape with an inner diameter smaller than a diameter of the wafer or (ii) a disklike shape;

attaching the base material to the holding hole; and after the attaching step, performing inner-circumferential-surface-forming processing on the base material to form the inner circumferential surface on the resin insert.

7. The manufacturing method of a carrier for a double-side polishing apparatus according to claim 6, wherein providing the base material includes forming the base material into either (i) the ring shape or (ii) the disklike shape.

8. The manufacturing method of a carrier for a double-side polishing apparatus according to claim 6, wherein the base material has the disklike shape.

* * * * *